US010773738B2

(12) United States Patent
Lanteri

(10) Patent No.: US 10,773,738 B2
(45) Date of Patent: Sep. 15, 2020

(54) SYSTEM AND METHOD FOR DETECTING THE PRESENCE OF A TRAIN ON A RAILWAY TRACK

(71) Applicant: ALSTOM Transport Technologies, Saint-Ouen (FR)

(72) Inventor: Giovanni Lanteri, Bologna (IT)

(73) Assignee: ALSTOM TRANSPORT TECHNOLOGIES, Saint-Ouen (FR)

( * ) Notice: Subject to any disclaimer, the term of this patent is extended or adjusted under 35 U.S.C. 154(b) by 274 days.

(21) Appl. No.: 15/941,610

(22) Filed: Mar. 30, 2018

(65) Prior Publication Data

US 2018/0281830 A1 Oct. 4, 2018

(30) Foreign Application Priority Data

Mar. 30, 2017 (EP) ..... 17305372

(51) Int. Cl.

| | |
|---|---|
| ***B61L 1/18*** | (2006.01) |
| ***B61L 25/02*** | (2006.01) |
| ***B61L 27/00*** | (2006.01) |

(52) U.S. Cl.

CPC ..... *B61L 1/187* (2013.01); *B61L 1/188* (2013.01); *B61L 25/02* (2013.01); *B61L 27/0077* (2013.01)

(58) Field of Classification Search

CPC .... B61L 1/00; B61L 1/02; B61L 1/025; B61L 1/14; B61L 1/18; B61L 1/181; B61L 1/185; B61L 1/187; B61L 25/00; B61L 25/02

See application file for complete search history.

(56) References Cited

U.S. PATENT DOCUMENTS

2004/0172216 A1* 9/2004 Davenport ..... B61L 23/041 702/182

FOREIGN PATENT DOCUMENTS

| | | | |
|---|---|---|---|
| DE | 3115863 | 10/1982 | |
| DE | 3115863 A1 * | 10/1982 | ..... B61L 23/166 |
| EP | 1780967 | 5/2007 | |

OTHER PUBLICATIONS

European Search Report for EP 17305372, dated Dec. 13, 2017.
Partial European Search Report for EP 17305372, dated Sep. 26, 2017.

* cited by examiner

*Primary Examiner* — Robert J McCarry, Jr.
(74) *Attorney, Agent, or Firm* — B. Aaron Schulman, Esq.; Stites & Harbison, PLLC

(57) ABSTRACT

A system for detecting the presence of a train on a railway track (1*b*) comprising a plurality of sections (2*a*", 2*b*", . . . , 2*n*"), the system comprising:

a transmitter (10*b*) arranged to emit a main signal towards the plurality of sections (2*a*", 2*b*", . . . , 2*n*");

a plurality of selecting devices (14*a*, 14*b*, . . . , 14*n*) associated respectively to the plurality of sections (2*a*", 2*b*", . . . , 2*n*") along the railway track (1*b*) and arranged to selectively allow passage of said main signal towards respective sections of said plurality of sections (2*a*", 2*b*", . . . , 2*n*");

a receiver (12*b*) arranged to receive the main signal after having passed through the plurality of sections (2*a*", 2*b*", . . . , 2*n*");

a control unit (20) associated to said receiver (12*b*) arranged to perform an analysis of said received signal so as to detect the presence of a train on a predetermined section (2*a*", 2*b*", . . . , 2*n*") of said plurality of sections (2*a*", 2*b*", 2*n*").

15 Claims, 3 Drawing Sheets

SYSTEM AND METHOD FOR DETECTING THE PRESENCE OF A TRAIN ON A RAILWAY TRACK

The present invention relates to a system and a method for detecting the presence of a train on a railway track.

It is well known that both in national mainlines railway tracks and in urban railway operations track signals along the rails themselves are necessary to detect the presence and/or position of trains.

Usual apparatuses to detect the presence of trains on railway tracks include systems and method exploiting the track circuit technology.

This technology is based on the general concept of sectioning the railway tracks in consecutive segments to be used for performing signaling steps, in particular by injecting on the rails, in each section, an electrical signal and deciding whether a train is present or not in each section upon reception of the injected electrical signal.

In fact, when a train is present on a section of the railway track, the train itself creates a short circuit for the signal injected between the rails, which is no more received at the end of the section. Each section is separated from an adjacent section by an insulation joint, which can be a mechanical device (for example a mechanical joint, mainly used for low frequencies) or an electrical device (for example an electrical joint, mainly used for audio frequencies).

The connection of the insulation joint to the rail is done through a "tuning box" placed in proximity of the insulation joint so as to assure a correct power transfer between the transmitter and the rails.

The electric signal is transmitted, in each section, by a respective transmitter placed at the beginning of the section, and received at the end of the section by an associated receiver. These existing solutions have therefore dedicated transmitters, receivers and wires for each section.

FIG. 1 shows a schematic view of a railway track 1 provided with a system for detecting the presence of a train on a railway track of the type above disclosed, wherein n sections 2*a*, 2*b*, . . . , 2*n* are monitored by respective transmitters 4*a*, 4*b*, . . . , 4*n* and associated receivers 6*a*, 6*b*, . . . , 6*n*. In each section 2*a*, 2*b*, . . . , 2*n* there is therefore a transmitter 4*a*, 4*b*, . . . , 4*n*, placed at the beginning of the section 2*a*, 2*b*, . . . , 2*n* itself, and arranged to send a signal to a corresponding receiver 6*a*, 6*b*, . . . , 6*n* placed at the end of the section 2*a*, 2*b*, . . . , 2*n*.

The number n is an integer comprised between 3 and 32 and preferably between 4 and 8.

The main drawback of this technology is that multiple wires connecting each transmitter to its receiver are needed, as well as many transmitters and receivers located in the station or along the railway tracks. In addition, all the components require constant adjustment and maintenance, therefore, this approach is time consuming and expensive.

Another different method for detecting the presence of a train on a railway track is based on the technique of sharing a same component among different users, which is commonly known as multiplexing, and can be done in two different domains, time and/or frequency.

The multiplexing technique has already been applied to track circuits by performing a time multiplexing of the transmitter, with a mechanical switch placed in a technical room of a station of a railway track and one couple of wires for transmission and one couple of wires for reception for each section. In this solution, the mechanical switch is allocated to each section on a same carrier frequency for a predetermined time, preferably 125 ms per second, and for each section there are dedicated wires connecting the reception side of the section to the technical room where the mechanical switch is placed.

FIG. 2 shows a schematic view of a railway track 1*a* provided with a system for detecting the presence of a train on a railway track having a multiplexing device. In particular in a technical room 8*a* there are a transmitter 10*a*, one or more receivers 12*a* and a mechanical or electronic switch 14 suitable to connect in turn the transmitter 10*a* and the receiver(s) 12*a* to different sections 2*a*', 2*b*', . . . , 2*n*'.

The disadvantage of this system is that the switch 14 takes time to connect each time the sections 2*a*', 2*b*', . . . , 2*n*' of the railway track 1*a* to the transmitter 10*a* and the receiver 12*a*, and that the system needs dedicated wires for each section.

There is therefore the need to replace the systems of the prior art with a solution that is capable of providing a safe and reliable train detection, in particular according to SIL-4 (Safety Integrity Level 4) without requiring too many cables, transmitters and receivers placed along the railway tracks or in the technical room in the station.

An object of the present invention is therefore to provide a system and a method for detecting the presence of a train on a railway track which neither requires multiple transmitters and receivers located along the railway tracks nor a centralized switch in the technical room for performing a time multiplexing transmission of signals.

This and other objects are achieved by a system for detecting the presence of a train on a railway track having the characteristics defined in claim 1 and by a corresponding method having the characteristics defined in claim 13.

Particular embodiments of the invention are the subject of the dependent claims, whose content is to be understood as an integral or integrating part of the present description.

Further characteristics and advantages of the present invention will become apparent from the following description, provided merely by way of a non-limiting example, with reference to the enclosed drawings, in which:

FIG. 1, already disclosed, shows a schematic view of a railway track provided with a first system for detecting the presence of a train of the prior art;

FIG. 2, already disclosed, shows a schematic view of a railway track provided with a second system for detecting the presence of a train of the prior art;

Briefly, the system of the present invention uses a same transmitter, a same receiver and same wires to control more than one section by using selective coupling with the railway track sections.

In a preferred embodiment of the present invention, the system uses selective band-pass filters (selecting devices) placed in proximity of the insulation joints (in particular, near or in the tuning box) and uses the same transmitter, receiver and wires for transmitting and receiving an electric signal having multiple carrier frequencies, having only one passage of signal through each band-pass filter connected to each section.

Each band-pass filter assures that on the respective section only the corresponding carrier is transmitted and received. Once the transmitted signal is received by the receiver, after having passed through all the sections, it is possible to discover the missing carriers by performing a spectrum analysis of the received signal.

The missing carriers identify the corresponding sections which are occupied by a train. In fact, when a train is present on a section of the railway track, the signal transmitted in such section on the rails is interrupted because of a short-circuit happening between the rails caused by the train axles.

Figure 1:
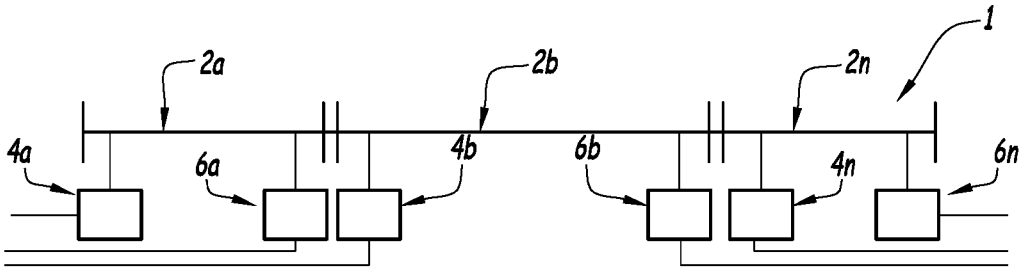
Figure 2:
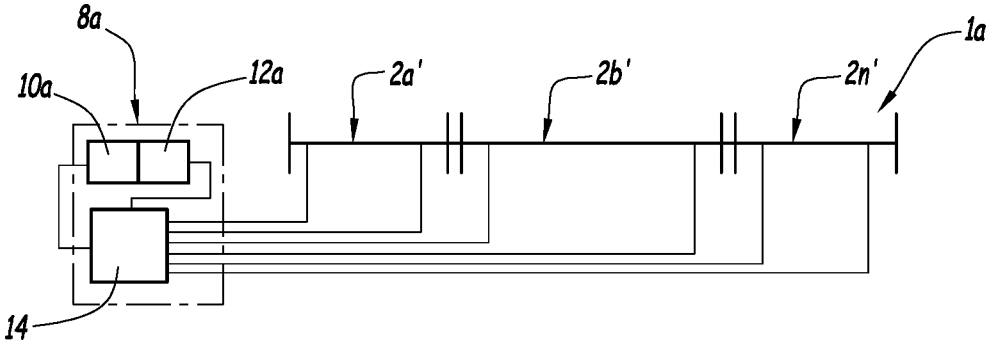
Figure 3:
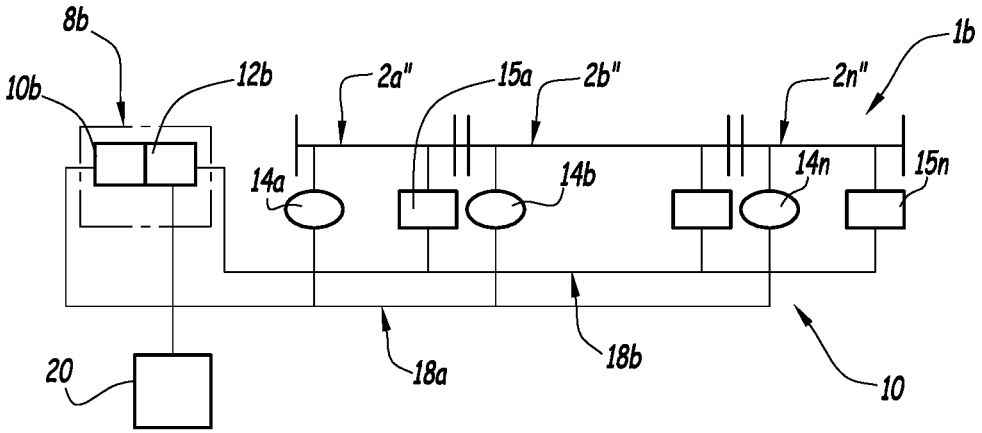
FIG. 3 shows a schematic view of a railway track provided with a system for detecting the presence of a train according to the present invention.

FIG. 3 shows a schematic view of a railway track 1*b* provided with a system for detecting the presence of a train 10 according to the present invention, wherein to n sections 2*a*", 2*b*", . . . , 2*n*" are associated n respective carrier frequencies $f_1, f_2, \ldots, f_n$.

The sections 2*a*", 2*b*", . . . , 2*n*" are separated from one another with an insulation joint as described above.

The system 10 comprises a transmitter 10*b* capable of emitting on a first couple of wires 18*a* a main signal comprising the n frequencies $f_1, f_2, \ldots, f_n$. The system 10 further comprises n selective coupling units with the railway track sections, such as band pass filters 14*a*, 14*b*, . . . , 14*n* associated respectively to the n sections 2*a*", 2*b*", . . . , 2*n*" and placed along the railway track 1*b* to allow only the passage of portions of said main signal. In particular, a first filter 14*a* allows the passage, into a first section 2*a*", of the portion of the main signal having a first frequency $f_1$; the second filter 14*b* allows the passage, into a second section 2*b*", of the portion of the main signal having a second frequency $f_2$; the $n^{th}$ filter 14*n* allows the passage, into the $n^{th}$ section 2*n*", of the portion of the main signal having a $n^{th}$ frequency.

The system 10 also comprises a receiver 12*b* arranged to receive the main emitted signal, after its passage into the sections 2*a*", 2*b*", . . . , 2*n*", through a second couple of wires 18*b*, this received main signal being also called return signal. Advantageously, the system 10 further comprises n selective band pass filters 15*a*, 15*b*, . . . , 15*n* associated respectively to the n sections 2*a*", 2*b*", . . . , 2*n*" and placed along the railway track 1*b*, arranged to allow only the passage of portions of said return signal towards the receiver 12*b*. In particular, a first filter 15*a* allows the passage, into the couple of wires 18*b*, of the portion of the return signal circulating into the first section 2*a*" and having the first frequency $f_1$; the second filter 15*b* allows the passage, into the couple of wires 18*b*, of the portion of the return signal circulating into the second section 2*b*" and having the second frequency $f_2$, the $n^{th}$ filter 15*n* allows the passage, into the couple of wires 18*b*, of the portion of the return signal circulating into the $n^{th}$ section and having the $n^{th}$ frequency $f_n$.

The system further comprises a logic control unit 20, connected to the receiver 12*b*, which is arranged to perform a spectrum analysis of the return signal in order to detect possible missing frequencies.

For example, the control unit 20 comprises a processor and a memory containing a spectrum analysis software application able to be carried out by the processor.

The control unit 20 detect therefore the presence of a train on a predetermined section 2*a*", 2*b*", . . . , 2*n*" if the respective frequency $f_1, f_2, \ldots, f_n$ is missing from the received signal.

For example, if a train is present on the second section 2*b*", the received signal comprises only the first frequency $f_1$ and the $n^{th}$ frequencies $f_n$.

The transmitter 10*b* and the receiver 12*b* may both be hosted in a common technical room 8*b* placed at the beginning of the all sections 2*a*", 2*b*", . . . , 2*n*" or in a different geographical location.

Advantageously, also the control unit 20 is placed inside the receiver 12*b* or in a specific unit installed in the same technical room 8*b*.

The detection of a failure of any of the selective band pass filters 14*a*, 14*b*, . . . , 14*n* and 15*a*, 15*b*, . . . , 15*n* must be done in SIL-4 mode but the use of two selective band pass filters per section implies that, in order to have a wrong way failure, at least two band pass filter shall be in error. Advantageously, the system 10 also comprises additional control carriers to check failures of the band pass filters 14*a*, 14*b*, . . . , 14*n* and 15*a*, 15*b*, . . . , 15*n*: these control carriers are sent by the transmitter 10*b* on the main signal and they are arranged to be rejected by all filters 14*a*, 14*b*, . . . , 14*n* and 15*a*, 15*b*, . . . , 15*n*, therefore, if any of them reaches the receiver 12*b*, this means that there is a failure in the corresponding filter 14*a*, 14*b*, . . . , 14*n*, 15*a*, 15*b*, . . . , 15*n* which should have rejected it.

The band pass filters 14*a*, 14*b*, . . . , 14*n* and 15*a*, 15*b*, . . . , 15*n* can be passive, active or based on a frequency conversion technique (superheterodyne) to assure a sufficient frequency separation.

Figure 4:
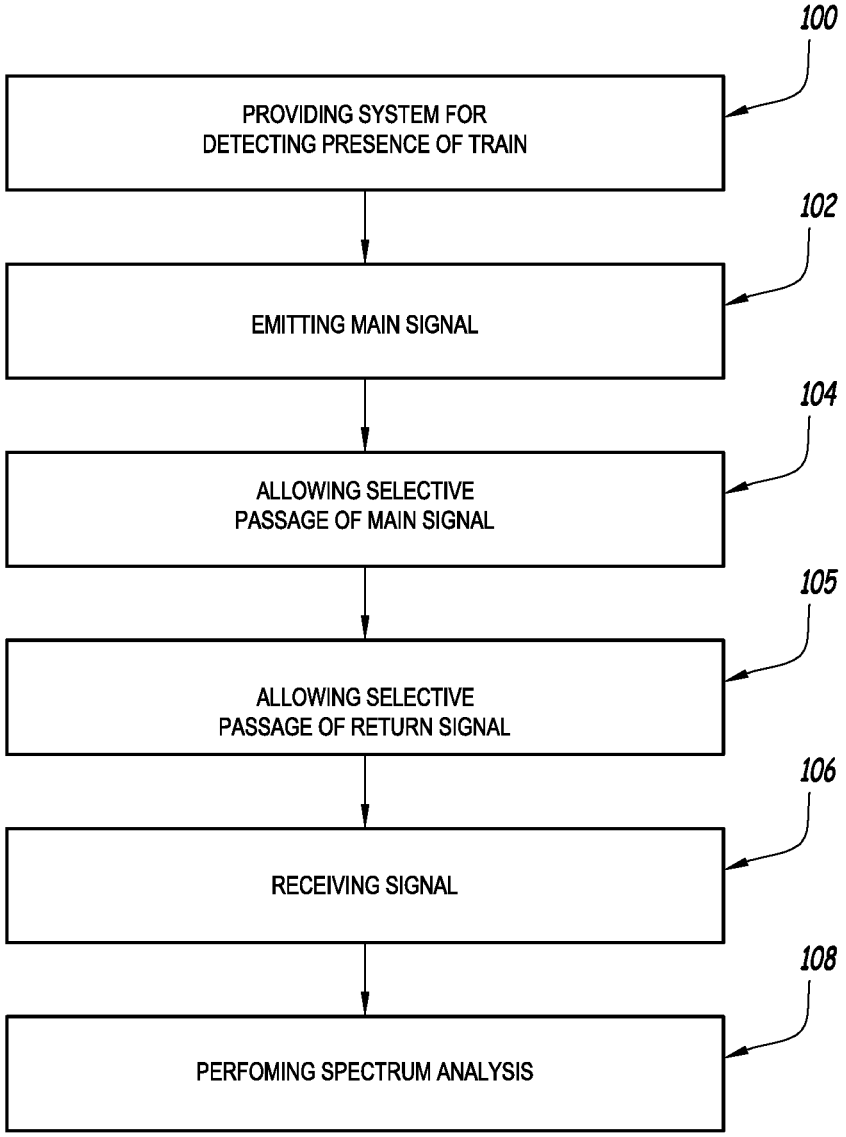
FIG. 4 shows a block diagram of the steps of a method for detecting the presence of a train on a railway track according to the present invention.

FIG. 4 shows a block diagram of the steps performed by a method for detecting the presence of a train on a railway track according to the present invention.

In a first step 100, a system for detecting the presence of a train on a railway track having the band-pass filters 14*a*, 14*b*, . . . , 14*n* and 15*a*, 15*b*, . . . , 15*n* as above disclosed is provided on a railway track 1*b*.

In a subsequent step 102 a main signal including a plurality of frequencies $f_1, f_2, \ldots, f_n$ is emitted by the transmitter 10*b* into a first couples of wires 18*a* going towards the sections 2*a*", 2*b*", . . . , 2*n*".

In step 104 the band-pass filters 14*a*, 14*b*, . . . , 14*n* allow passage into the respective sections 2*a*", 2*b*", . . . , 2*n*" of only the portions of the main signal having the associated frequency $f_1, f_2, f_n$.

In step 105 the band-pass filters 15*a*, 15*b*, . . . , 15*n* allow passage into the couples of wires 18*b* of only the portions of the return signal having the associated frequency $f_1, f_2, \ldots f_n$.

In step 106 return signals having passed through all the sections 2*a*", 2*b*", . . . , 2*n*" are received by the receiver 12*b*.

In step 108 a spectrum analysis of a received signal corresponding to the combination of the return signals having passed through all the sections 2*a*", 2*b*", . . . 2*n*", is performed, in order to detect possible missing frequencies.

In particular, the spectrum analysis includes the step of checking whether one or more frequencies are missing in the received signal, this meaning that a train is present in the corresponding section 2*a*", 2*b*", . . . 2*n*".

In an alternative embodiment of the invention, in order to maximize the length of the sections 2*a*", 2*b*", . . . , 2*n*" and to decrease the spacing in frequencies (so as to increase the number of sections managed with the same transmitter 10*b* and receiver 12*b*) a time multiplexing is added to the frequency multiplexing.

In this case, a predetermined time interval, for example 1 second, is divided into sub-intervals, for example four sub-intervals of 125 ms. The transmitter 10*b* firstly concentrates all its power on the first carrier at the first frequency $f_1$, for a first sub-interval, then it moves to the second carrier at the second frequency $f_2$ for a second sub-interval, and so on, until it restarts the cycle.

The advantage of this solution is that all the power of the transmitter is concentrated on one section for a predetermined time interval instead of being diluted on more sections for all the time. This solution allows to cover greater length distances for the sections 2*a*", 2*b*", . . . , 2*n*" while increasing the minimum time to detect the presence of the train in the section 2*a*", 2*b*", . . . , 2*n*".

The band pass filters 14*a*, 14*b*, . . . , 14*n* and 15*a*, 15*b*, . . . , 15*n* assure the selectivity of the passage of the main and return signal in the sections 2*a*", 2*b*", . . . , 2*n*". Advantageously, the band bass filters 14*a*, 14*b*, . . . , 14*n* and 15*a*, 15*b*, . . . , 15*n* comprise a relay or a solid state switch (transistor based) remotely controlled by the transmitted carrier via the transmission frequency ($f_1$, $f_2$, . . . , $f_n$). In particular, each filter 14*a*, 14*b*, . . . , 14*n* and 15*a*, 15*b*, . . . , 15*n* has a normally open switch which is closed only upon reception of the corresponding frequency $f_1$, $f_2$, . . . , $f_n$.

At the end, the spectrum and time domain analysis of the received signal above disclosed is performed, so as to identify the presence of a train on one or more sections 2*a*", 2*b*", . . . , 2*n*".

In particular, the control unit 20 performs a time and a frequency domain analysis of the received signal by considering a train present on a predetermined section 2*a*", 2*b*", . . . , 2*n*" if the frequency $f_1$, $f_2$, . . . , $f_n$ associated to said section 2*a*", 2*b*", . . . , 2*n*" is missing from the received signal at the associated time sub-interval.

In a further alternative embodiment of the invention, a pure time multiplexing using a single carrier (having a unique frequency f) for all the sections 2*a*", 2*b*", . . . , 2*n*" is used. In this case electronic or relay switches (selecting devices) placed in replacement of the band-pass filters 14*a*, 14*b*, . . . , 14*n* and 15*a*, 15*b*, . . . , 15*n* are controlled through an auxiliary signal coded and superposed to the main signal having the unique frequency f and being emitted by the transmitter 10*b*, under control of the control unit 20.

In this case again, a predetermined time interval, for example 1 second, is divided into sub-intervals, for example four sub-intervals of 125 ms. The transmitter 10*b* firstly concentrates all its power on the unique frequency f for a first sub-interval towards the first section 2*a*", then it moves in second sub-interval towards the second section 2*b*", and so on, until it restarts the cycle.

The control unit 20 is able to carry out a time domain signal analysis to analyze whether a signal has been received in a particular time interval. The control unit 20 for example executes a time domain signal analysis method through a processor.

Figure 5:
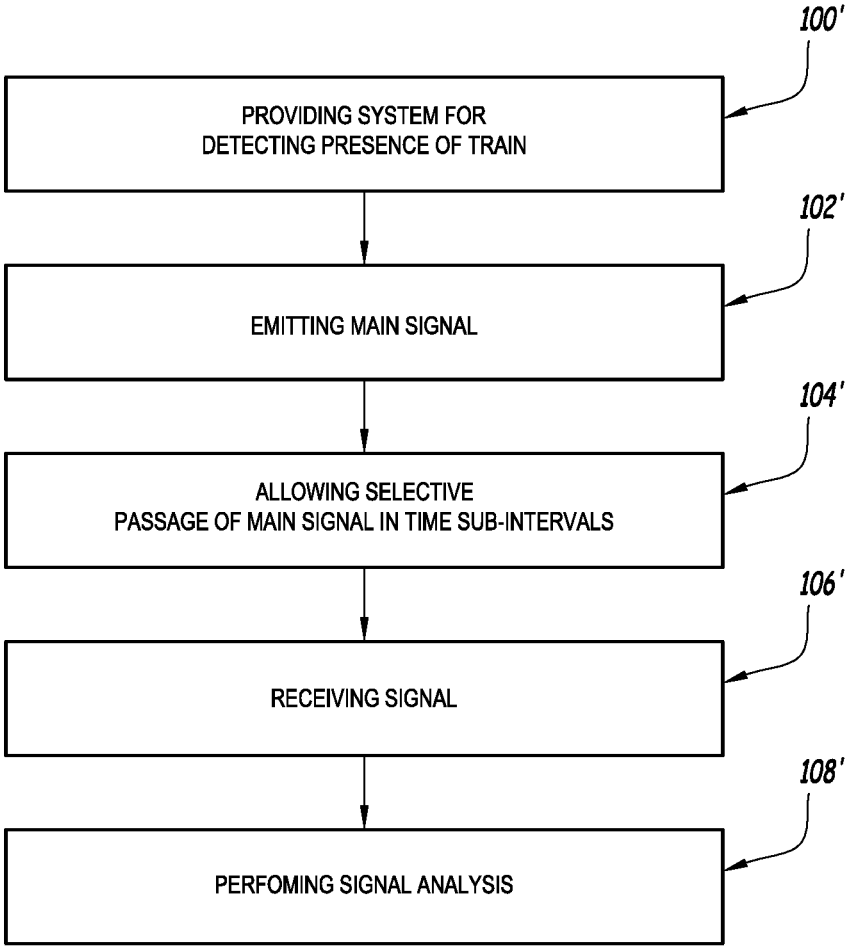
FIG. 5 shows a block diagram of the steps of an alternative embodiment of the method for detecting the presence of a train on a railway track according to the present invention.

FIG. 5 shows a block diagram of the steps performed by an alternative method for detecting the presence of a train on a railway track according to the present invention.

In a first step 100', a system for detecting the presence of a train of the type as above disclosed having electronic or relay switches in replacement of the band-pass filters 14*a*, 14*b*, . . . , 14*n* and 15*a*, 15*b*, . . . , 15*n* is provided on a railway track 1*b*.

Then, in step 102', a main signal at frequency f is emitted by the transmitter 10*b* towards the sections 2*a*", 2*b*", . . . , 2*n*".

In a further step 104' the electronic or relay switches allow selective passage of the main signal into the respective sections 2*a*", 2*b*", . . . , 2*n*". In this case, the selective passage is the passage of the signal in each sub-interval in the associated section 2*a*", 2*b*", . . . , 2*n*".

In a subsequent step 106' return signals having passed through the plurality of sections 2*a*", 2*b*", . . . , 2*n*" are received by the receiver 12*b* and at the end the control unit 20 performs, in a final step 108', a signal analysis of the received signal in order to detect whether a train is present on a predetermined section 2*a*", 2*b*", . . . , 2*n*".

In particular, this signal analysis comprises the step of checking whether a return signal is missing in a predetermined sub-interval, this indicating that a train is present on the associated section 2*a*", 2*b*", . . . , 2*n*".

The energy supply for the selecting devices can be provided through the same first couple of wires 18*a* used for transmitting the main signal, by using an appropriate frequency not to disturb the transmission.

The system of the present invention can be applied to both low frequency track circuits (0 to 1000 Hz) and audio frequency track circuits (1000 Hz to 65 kHz).

In a further alternative embodiment of the present invention, features which have been disclosed with reference to any of the previous embodiments may be combined each other in any technically possible way to obtain a system having only different subsets of these features.

The main advantage of the system and the method of the present invention is to reduce the number of equipment and wires needed to detect the presence of a train on a railway track, thus reducing the costs of the solution. The disadvantage of losing more than one section in case of failure of the unique transmitter and/or receiver can be mitigated using two transmitters and two receivers opportunely mounted to work in redundant configuration on the same sections 2*a*", 2*b*", . . . , 2*n*".

The reduction of transmitters and receivers allows reducing the number of accessories required (cabinets, power supply, etc.) while the use of the same wires allows also the reduction of connectors, surge arrestors, cable frames etc.

Clearly, the principle of the invention remaining the same, the embodiments and the details of production can be varied considerably from what has been described and illustrated purely by way of non-limiting example, without departing from the scope of protection of the present invention as defined by the attached claims.

The invention claimed is:

1. A system for detecting the presence of a train on a railway track comprising a plurality of sections, the system comprising:

a transmitter arranged to emit a main signal towards the plurality of sections;

a plurality of selecting devices associated respectively to the plurality of sections along the railway track and arranged to selectively allow passage of said main signal towards respective sections of said plurality of sections;

a receiver arranged to receive the main signal after having passed through the plurality of sections; and a control unit associated to said receiver arranged to perform an analysis of said received signal so as to detect the presence of a train on a predetermined section of said plurality of sections;

wherein the transmitter is arranged to emit a main signal comprising a plurality of frequencies and to firstly concentrate all its power on a first carrier at a first frequency for a predetermined first time interval, then to move to a second carrier at a second frequency for a predetermined second time interval, then to go on until to complete the sending of all the frequencies of the plurality of frequencies; and wherein the plurality of selecting devices comprises electronic switches associated respectively to the plurality of sections, each electronic switch being arranged to allow the passage of the main signal on a respective section of said plurality of sections for only a time interval wherein the main signal has the corresponding frequency.

2. The system of claim 1, wherein:

the control unit is arranged to perform a spectrum analysis of the received signal so as to detect missing frequencies, wherein a train is considered present on a predetermined section if the frequency associated to said section is missing from the received signal.

3. The system of claim 2, wherein the transmitter is configured to send additional control carriers arranged to be rejected by all the pass-band filters on the main signal to check failures of the band pass filters.

4. The system of claim 2, wherein the selecting devices are passive, active or based on a frequency conversion technique band-pass filters.

5. The system of claim 2, wherein the transmitter is arranged to firstly concentrate all its power on a first carrier at a first frequency for a predetermined first time interval, then to move to a second carrier at a second frequency for a predetermined second time interval, then to go on until to complete the sending of all the frequencies of the plurality of frequencies.

6. The system of claim 5, wherein the control unit is arranged to perform a time and a frequency domain analysis of the received signal so as to detect missing frequencies in time intervals, wherein a train is considered present on a predetermined section if the frequency associated to said section is missing from the received signal at the associated time interval.

7. The system of claim 1, wherein the transmitter and the receiver are hosted in a common technical room placed at the beginning of the plurality of sections.

8. The system of claim 1, wherein the control unit is placed in a technical room or inside the receiver.

9. The system of claim 1, wherein the control unit is arranged to perform a time and a frequency domain analysis of the received signal so as to detect missing frequencies in time intervals, wherein a train is considered present on a predetermined section if the frequency associated to said section is missing from the received signal at the associated time interval.

10. The system of claim 1, wherein:

the transmitter is arranged to emit a main signal having a unique frequency;

the plurality of selecting devices comprises electronic switches associated respectively to the plurality of sections, each electronic switch being arranged to allow the passage of the main signal on a respective section of said plurality of sections for only a predetermined corresponding progressive time interval; and the control unit is arranged to perform a time domain analysis of the received signal so as to detect when the received signal is missing, wherein a train is considered present on a predetermined section if the received signal is missing in the corresponding time interval.

11. The system according claim 1, further comprising a connection among the transmitter and the selecting devices, able to carry also power supply for the selective devices and/or a connection among the receiver and the selecting devices able to carry also power supply for the selective devices.

12. A method for detecting the presence of a train on a railway track comprising:

providing a system for detecting the presence of a train on a railway track, said system comprising:

a transmitter arranged to emit a main signal towards the plurality of sections;

a plurality of selecting devices associated respectively to the plurality of sections along the railway track and arranged to selectively allow passage of said main signal towards respective sections of said plurality of sections;

a receiver arranged to receive the main signal after having passed through the plurality of sections; and a control unit associated to said receiver arranged to perform an analysis of said received signal so as to detect the presence of a train on a predetermined section of said plurality of sections;

emitting a main signal towards the sections;

allowing selective passage into the respective sections of said main signal;

receiving the emitted signal after being passed through the plurality of sections; and performing a signal analysis of the received signal in order to detect whether a train is present on a predetermined section, wherein:

providing a system for detecting the presence of a train comprises providing a system in which:

the transmitter is arranged to emit a main signal having a unique frequency;

the plurality of selecting devices comprises electronic switches associated respectively to the plurality of sections, each electronic switch being arranged to allow the passage of the main signal on a respective section of said plurality of sections for only a predetermined corresponding progressive time interval;

the control unit is arranged to perform a time domain analysis of the received signal so as to detect when the received signal is missing, wherein a train is considered present on a predetermined section if the received signal is missing in the corresponding time interval;

emitting a main signal includes the operation of emitting a signal having a unique frequency;

allowing selective passage of said main signal includes allowing, through the electronic switches, the passage of the main signal into the respective sections for corresponding progressive time intervals; and performing a signal analysis includes performing a time domain analysis of the received signal so as to detect when the received signal is missing, wherein a train is considered present on a predetermined section if the received signal is missing in the corresponding time intervals.

13. The method according to claim 12, wherein:

providing a system for detecting the presence of a train comprises providing a system in which:

the transmitter is arranged to emit a main signal comprising a plurality of frequencies;

the plurality of selecting devices comprises band-pass filters associated respectively to the plurality of sections, each band-pass filter being arranged to allow the passage on a respective section of said plurality of sections of only a portion of the main signal having a predetermined frequency of said plurality of frequencies; and the control unit is arranged to perform a spectrum analysis of the received signal so as to detect missing frequencies, wherein a train is considered present on a predetermined section if the frequency associated to said section is missing from the received signal emitting a main signal includes the operation of emitting a signal having a plurality of frequencies;

allowing selective passage of said main signal includes allowing, through the band-pass filters, the passage into the respective sections of only the portions of the main signal having the associated frequencies; and performing a signal analysis includes performing a spectrum analysis of the received signal in order to detect missing frequencies, wherein a train is considered present on a predetermined section if the frequency associated to said section is missing from the received signal.

14. A method according to claim 12, wherein performing a signal analysis further comprises performing a spectrum analysis of the received signal in order to detect missing frequencies, wherein a train is considered present on a predetermined section if the frequency associated to said section is missing from the received signal.

15. A system for detecting the presence of a train on a railway track comprising a plurality of sections, the system comprising:

a transmitter arranged to emit a main signal towards the plurality of sections;

a plurality of selecting devices associated respectively to the plurality of sections along the railway track and arranged to selectively allow passage of said main signal towards respective sections of said plurality of sections;

a receiver arranged to receive the main signal after having passed through the plurality of sections; and a control unit associated to said receiver arranged to perform an analysis of said received signal so as to detect the presence of a train on a predetermined section of said plurality of sections;

wherein:

the transmitter is arranged to emit a main signal comprising a plurality of frequencies;

the plurality of selecting devices comprises band-pass filters associated respectively to the plurality of sections, each band-pass filter being arranged to allow the passage on a respective section of said plurality of sections of only a portion of the main signal having a predetermined frequency of said plurality of frequencies; and the control unit is arranged to perform a spectrum analysis of the received signal so as to detect missing frequencies, wherein a train is considered present on a predetermined section if the frequency associated to said section is missing from the received signal, and wherein the transmitter is configured to send additional control carriers arranged to be rejected by all the pass-band filters on the main signal to check failures of the band pass filters.

* * * * *